US010274894B2

(12) United States Patent
Masaki

(10) Patent No.: US 10,274,894 B2
(45) Date of Patent: Apr. 30, 2019

(54) IMAGE FORMING APPARATUS INCLUDING APPARATUS MAIN BODY WHICH HAS MAIN BODY SIDE CONNECTOR AND UNIT WHICH HAS UNIT SIDE CONNECTOR TO BE FITTED TO MAIN BODY SIDE CONNECTOR

(71) Applicant: KYOCERA Document Solutions Inc., Osaka (JP)

(72) Inventor: Akihiro Masaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/038,982

(22) Filed: Jul. 18, 2018

(65) Prior Publication Data

US 2019/0064730 A1 Feb. 28, 2019

(30) Foreign Application Priority Data

Aug. 23, 2017 (JP) ..... 2017-160113

(51) Int. Cl.
*G03G 15/00* (2006.01)
*G03G 21/16* (2006.01)
*G03G 21/18* (2006.01)

(52) U.S. Cl.
CPC ..... *G03G 21/1661* (2013.01); *G03G 21/1867* (2013.01); *G03G 2221/163* (2013.01); *G03G 2221/1606* (2013.01); *G03G 2221/1639* (2013.01)

(58) Field of Classification Search
CPC ..... G03G 15/80; G03G 21/1661; G03G 21/1676; G03G 21/1867; G03G 2221/1606; G03G 2221/163; G03G 2221/166; G03G 2221/1639
See application file for complete search history.

(56) References Cited

U.S. PATENT DOCUMENTS

2006/0013600 A1* 1/2006 Kang ..... G03G 15/0875 399/13
2013/0163998 A1* 6/2013 Mizusawa ..... G03G 21/1871 399/12
2014/0099143 A1* 4/2014 Oda ..... G03G 21/1821 399/110
2015/0063866 A1* 3/2015 Kang ..... G03G 21/1676 399/113
2018/0267460 A1* 9/2018 Shigemori ..... G03G 21/1871

FOREIGN PATENT DOCUMENTS

JP H04-152359 A 5/1992

* cited by examiner

*Primary Examiner* — Sophia S Chen
(74) *Attorney, Agent, or Firm* — Studebaker & Brackett PC

(57) ABSTRACT

An image forming apparatus includes an apparatus main body and a unit. The unit is detachably attached to the apparatus main body along one direction. The apparatus main body includes a main body side board and a main body side connector. The main body side connector is mounted on the main body side board. The unit includes a unit side board, a unit side connector, a supporting member and a biasing member. The unit side connector is mounted on the unit side board and fitted to the main body side connector from a first side in the one direction as the unit is attached to the apparatus main body. The supporting member supports the unit side board so as to be movable along the one direction. The biasing member biases the unit side board to a second side in the one direction.

7 Claims, 6 Drawing Sheets

IMAGE FORMING APPARATUS INCLUDING APPARATUS MAIN BODY WHICH HAS MAIN BODY SIDE CONNECTOR AND UNIT WHICH HAS UNIT SIDE CONNECTOR TO BE FITTED TO MAIN BODY SIDE CONNECTOR

INCORPORATION BY REFERENCE

This application is based on and claims the benefit of priority from Japanese patent application No. 2017-160113 filed on Aug. 23, 2017, which is incorporated by reference in its entirety.

BACKGROUND

The present disclosure relates to an image forming apparatus.

An image forming apparatus conventionally includes various units such as a development unit, a drum unit and a fixing unit. These units are detachably attached to an apparatus main body of the image forming apparatus.

The above unit includes a unit side connector while the above apparatus main body includes a main body side connector. Then, as the unit is attached to the apparatus main body, the unit side connector is fitted to the main body side connector to allow electrical communication between the unit and the apparatus main body.

For example, an image forming apparatus includes a print cartridge capable of being inserted to the apparatus main body. On a far side end wall of the print cartridge, a cartridge side connector is protruded, and a main body side connector is protruded on the apparatus main body. When the print cartridge is inserted into the apparatus main body, the both connectors are connected to each other.

SUMMARY

In accordance with an aspect of the present disclosure, an image forming apparatus includes an apparatus main body and a unit. The unit is detachably attached to the apparatus main body along one direction. The apparatus main body includes a main body side board and a main body side connector. The main body side connector is mounted on the main body side board. The unit includes a unit side board, a unit side connector, a supporting member and a biasing member. The unit side connector is mounted on the unit side board and fitted to the main body side connector from a first side in the one direction as the unit is attached to the apparatus main body. The supporting member supports the unit side board so as to be movable along the one direction. The biasing member biases the unit side board to a second side in the one direction.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus 1 according to an embodiment of the present disclosure will be described. Arrows Fr, Rr, L, R, U and Lo suitably marked in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral multiply containing a print function, a copying function and a facsimile function.

Figure 1:
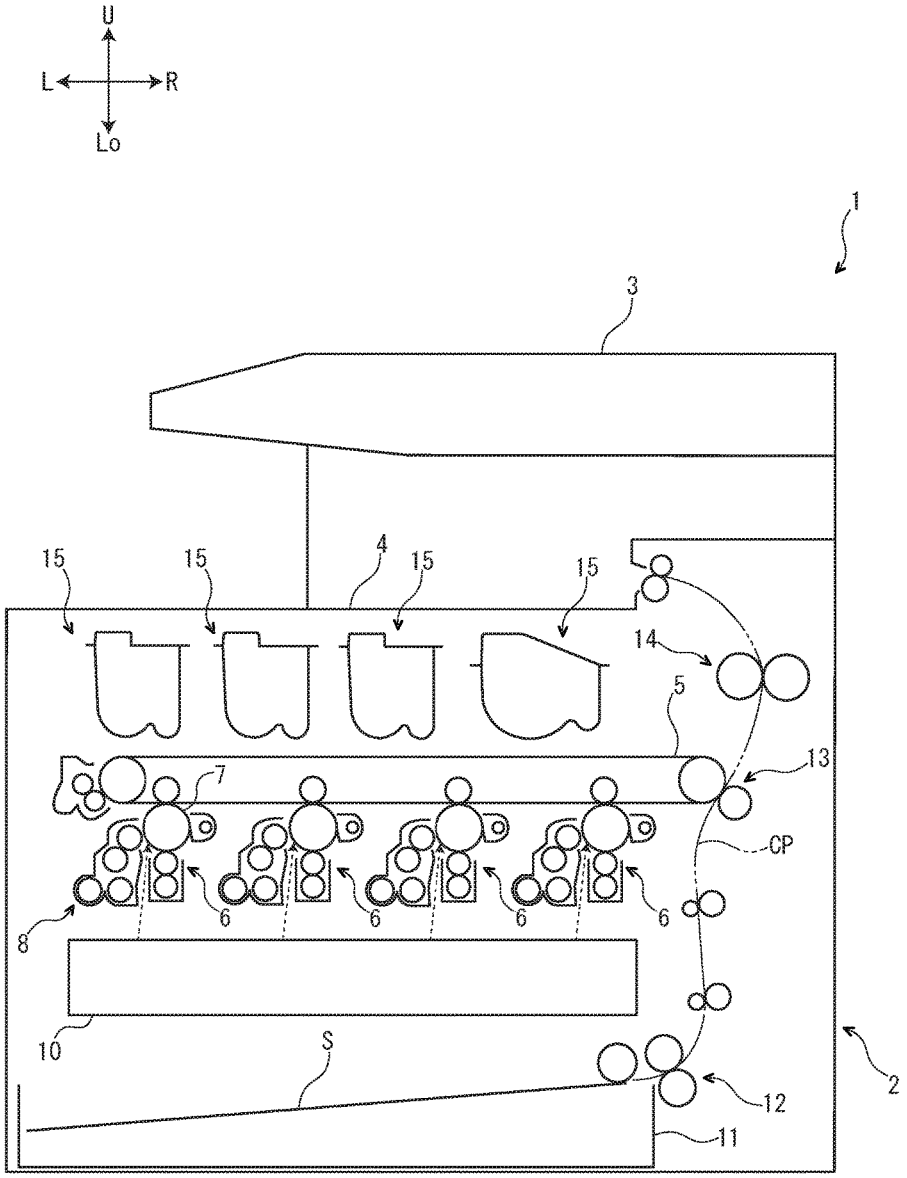
FIG. 1 is a schematic view showing an image forming apparatus according to an embodiment of the present disclosure.

As shown in FIG. 1, the image forming apparatus 1 includes a box-shaped apparatus main body 2. At an upper end portion of the apparatus main body 2, an image reading device 3 configured to read an image of a document is provided.

In an upper portion of the apparatus main body 2, an ejected sheet tray 4 is provided. In an approximately center portion of the apparatus main body 2, an intermediate transferring belt 5 and four image forming parts 6 are stored. The image forming parts 6 respectively correspond to black, cyan, magenta and yellow, for example. Each image forming part 6 includes a photosensitive drum 7 (an example of an image carrier) and a development unit 8. In a lower portion of the apparatus main body 2, an exposure device 10 is stored. In a lower end portion of the apparatus main body 2, a sheet feeding cassette 11 storing a sheet S (an example of a recording medium) is stored.

In a right side portion of the apparatus main body 2, a conveying path CP for the sheet S is provided. At an upstream side end portion of the conveying path CP, a sheet feeding part 12 is provided. At a midstream portion of the conveying path CP, a secondary transferring part 13 is provided. At a downstream portion of the conveying path CP, a fixing device 14 is provided.

In the upper portion of the apparatus main body 2, four toner containers 15 are stored below the ejected sheet tray 4. The toner containers 15 respectively store a toner of black, cyan, magenta and yellow, for example.

Next, an example of an operation of the image forming apparatus 1 will be described.

First, a laser (refer to a dotted line arrow in FIG. 1) from the exposure device 10 forms an electrostatic latent image on the photosensitive drum 7 of each image forming part 6. The electrostatic latent image is developed by the development unit 8 of each image forming part 6. Thereby, a toner image is carried on the photosensitive drum 7 of each image forming part 6. The toner image is primarily transferred on the intermediate transferring belt 5 from the photosensitive drum 7 of each image forming part 6. Thereby, a full color toner image is formed on the intermediate transferring belt 5.

On the other hand, the sheet S fed from the sheet feeding cassette 11 by the sheet feeding part 12 is conveyed to a downstream side along the conveying path CP and then enters the secondary transferring part 13. At the secondary transferring part 13, the full color toner image formed on the intermediate transferring belt 5 is secondarily transferred on the sheet S. The sheet S on which the toner image is secondarily transferred is further conveyed to the downstream side along the conveying path CP and then enters the fixing device 14. The fixing device 14 fixes the toner image on the sheet S. The sheet S on which the toner image is fixed is ejected on the ejected sheet tray 4.

Next, the development unit 8 will be further described.

Figure 2:
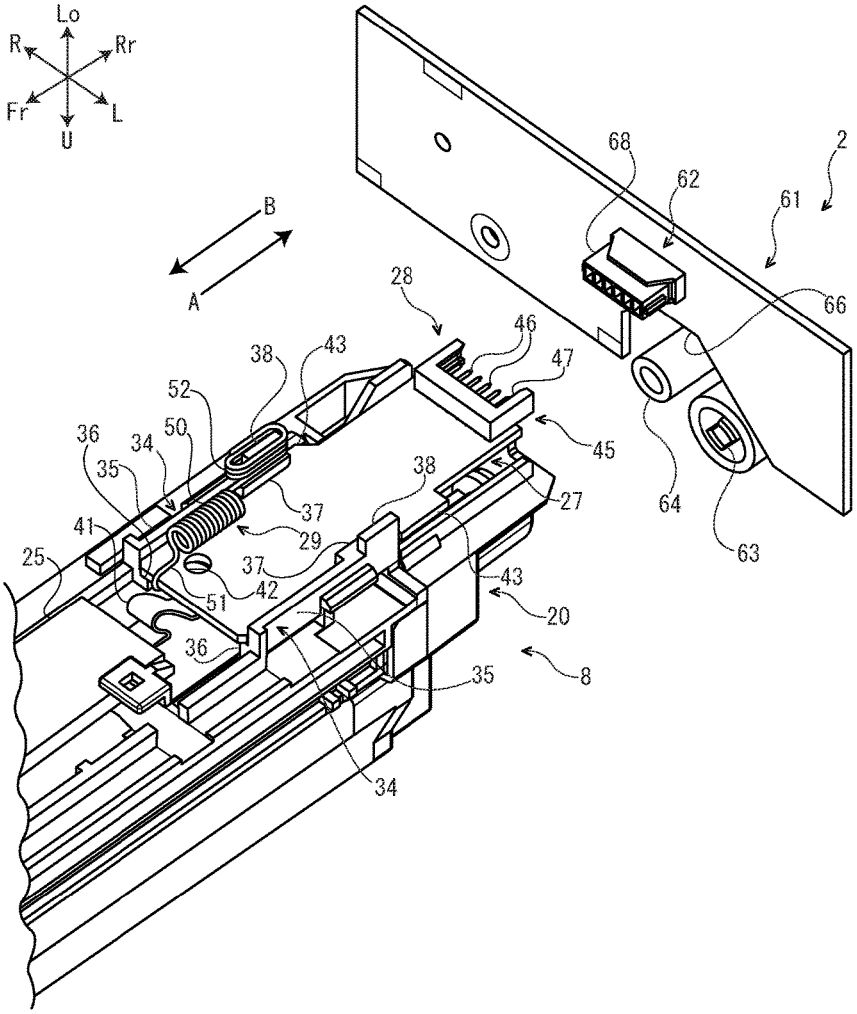
FIG. 2 is a perspective view showing an apparatus main body and a development unit according to the embodiment of the present disclosure.
Figure 4:
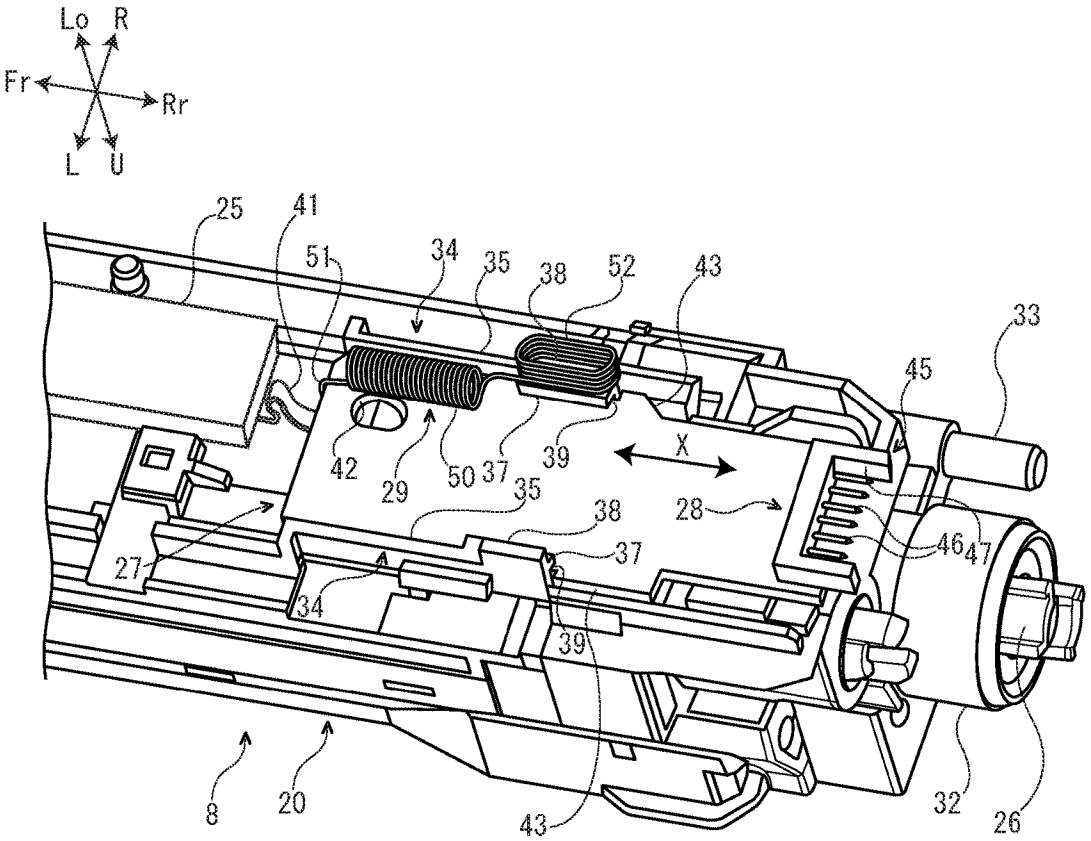
FIG. 4 is a perspective view showing a unit side board and its peripheral portions in the development unit according to the embodiment of the present disclosure.

FIG. 2 and FIG. 4 are perspective views viewed from a lower side, and a positional relationship in an upper-and-lower direction on the figure is reversed to a practical positional relationship in the upper-and-lower direction.

As shown in an arrow A in FIG. 2, the development unit 8 is pushed from a front side (a first side in a front-and-rear direction) to a rear side (a second side in the front-and-rear direction) to be attached to the apparatus main body 2. As shown in an arrow B in FIG. 2, the development unit 8 is drawn out from the rear side (the second side in the front-and-rear direction) to the front side (the first side in the front-and-rear direction) to be detached from the apparatus main body 2. As described above, the development unit 8 is detachably attached to the apparatus main body 2 along the front-and-rear direction (an example of one direction). That is, in the present embodiment, an attachment and detachment direction of the development unit 8 to the apparatus main body 2 is the front-and-rear direction.

Figure 3:
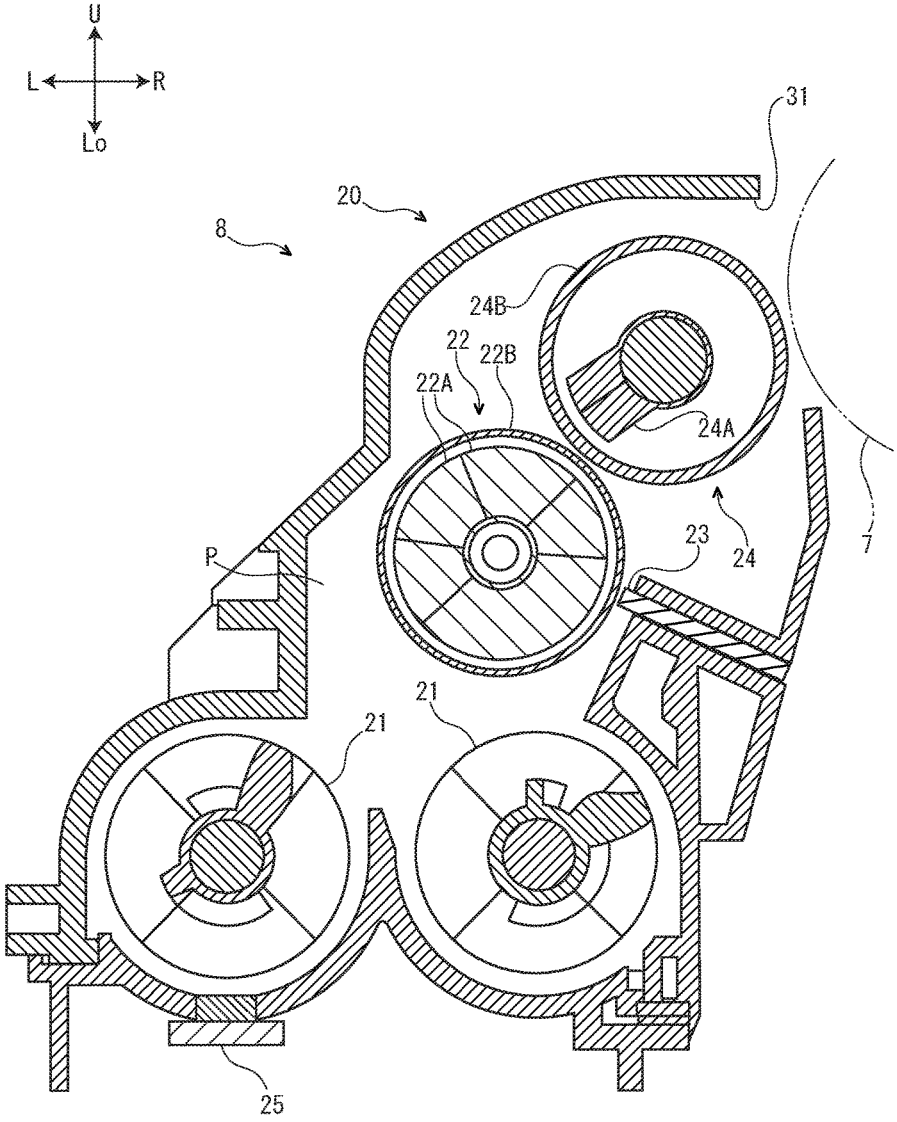
FIG. 3 is a sectional view showing the development unit according to the embodiment of the present disclosure.

With reference to FIG. 3 and FIG. 4, the development unit 8 includes a casing 20 (an example of a supporting member), a pair of left and right agitating screws 21 stored in a lower portion of the casing 20, a magnetic roller 22 stored in a center portion in the upper-and-lower direction of the casing 20, a blade 23 provided at a right side of the magnetic roller 22, a development roller 24 stored in an upper portion of the casing 20, a toner concentration sensor 25 fixed on a bottom wall of the casing 20, a unit side joint 26 provided at a rear side (the second side in the front-and-rear direction) of the casing 20, a unit side board 27 provided at a rear lower side of the casing 20, a unit side connector 28 mounted on a rear end portion (an end portion at the second side in the front-and-rear direction) of the unit side board 27 and a biasing member 29 provided at a right front side of the unit side board 27.

With reference to FIG. 3, inside the casing 20 of the development unit 8, a storage space P is formed. In the storage space P, a developer is stored. The developer is a two-component developer containing a non-magnetic toner and a magnetic carrier, for example. On an upper end portion of a right face of the casing 20, an opening part 31 is provided.

With reference to FIG. 4, on a center portion of a rear end face of the casing 20, a cylindrical holding part 32 is protruded to the rear side. On a right side portion of the rear end face of the casing 20, a columnar fitting protrusion 33 is protruded to the rear side.

Figure 5:
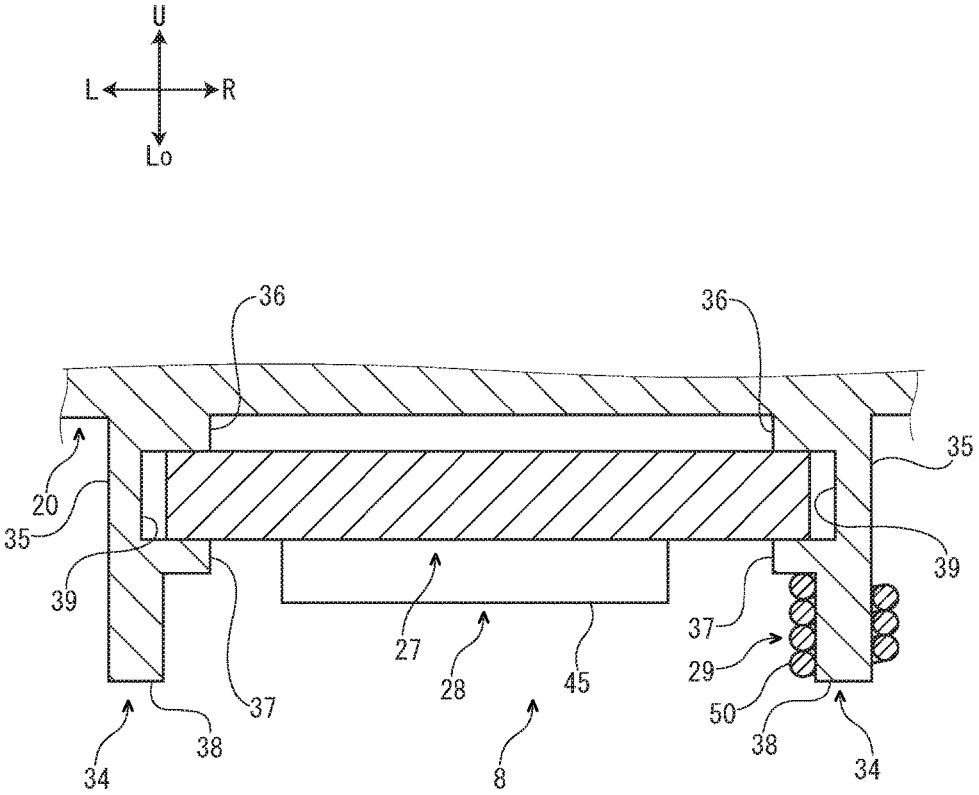
FIG. 5 is a sectional view showing the unit side board and its peripheral portions in the development unit according to the embodiment of the present disclosure.

With reference to FIG. 4 and FIG. 5, on a rear end portion of a bottom face of the casing 20, a pair of left and right guide parts 34 are protruded. Each guide part 34 extends along the front-and-rear direction. Each guide part 34 includes a base part 35, an upper side protrusion 36 protruding from an upper end portion of the base part 35 to an inner side in a left-and-right direction, a lower side protrusion 37 protruding from a lower end portion of the base part 35 to the inner side in the left-and-right direction and an engagement protrusion 38 protruding from the lower end portion of the base part 35 to the lower side. The base part 35 and the upper side protrusion 36 are formed continuously from a front end side to a rear end side of each guide part 34. The lower side protrusion 37 and the engagement protrusion 38 are formed only in a rear portion of each guide part 34. On a face at the inner side in the left-and-right direction of the base part 35, a guide groove 39 is provided between the upper side protrusion 36 and the lower side protrusion 37. The guide groove 39 extends along the front-and-rear direction.

With reference to FIG. 3, the pair of left and right agitating screws 21 of the development unit 8 are stored in the storage space P of the casing 20. Each agitating screw 21 has a shape elongated in the front-and-rear direction. Each agitating screw 21 is rotatably supported by the casing 20.

The magnetic roller 22 of the development unit 8 is stored in the storage space P of the casing 20. The magnetic roller 22 has a shape elongated in the front-and-rear direction. The magnetic roller 22 includes a plurality of unrotatable magnetic poles 22A and a rotatable sleeve 22B covering an outer circumference of the plurality of magnetic poles 22A.

The blade 23 of the development unit 8 is fixed to a right side portion of the casing 20. A tip end portion of the blade 23 faces an outer circumferential face of the sleeve 22B of the magnetic roller 22 at an interval.

The development roller 24 of the development unit 8 is stored in the storage space P of the casing 20. The development roller 24 has a shape elongated in the front-and-rear direction. The development roller 24 includes an unrotatable magnetic pole 24A and a rotatable sleeve 24B covering an outer circumference of the magnetic pole 24A. A right side portion of the sleeve 24B is exposed to an outside of the casing 20 through the opening part 31 of the casing 20, and faces an outer circumferential face of the photosensitive drum 7 at an interval.

The toner concentration sensor 25 of the development unit 8 is constituted by a magnetic permeability sensor, for example, and detects a toner concentration of the developer in the casing 20 based on a magnetic permeability of the developer in the casing 20.

With reference to FIG.4, the unit side joint 26 of the development unit 8 is rotatably held by the holding part 32 of the casing 20. The unit side joint 26 is connected to each agitating screw 21, the sleeve 22B of the magnetic roller 22 and the sleeve 24B of the development roller 24 via a gear train (not shown).

With reference to FIG. 4 and FIG. 5, the unit side board 27 of the development unit 8 is an IC board including a memory function. The unit side board 27 is formed in a flat plate shape elongated in the front-and-rear direction. The unit side board 27 is connected to the toner concentration sensor 25 via a cable 41. At a right front portion of the unit side board 27, a through hole 42 is provided.

An upper face of the unit side board 27 faces the bottom face of the casing 20 at an interval. Both left and right side portions (both side portions in a width direction) of the unit side board 27 are engaged with the guide groove 39 provided in each guide part 34 of the casing 20. Thereby, the unit side board 27 is supported by the casing 20 so as to be movable along the front-and-rear direction (refer to an arrow X in FIG. 4). On the left and right side portions of the unit side board 27, a pair of contact pieces 43 are protruded to both outer sides in the left-and-right direction (both outer sides in the width direction). A front edge portion of each contact piece 43 faces a rear edge portion of each guide part 34 of the casing 20 at an interval. When the unit side board 27 moves to the front side (the first side in the front-and-rear direction) with respect to the casing 20, the front edge portion of each contact piece 43 comes into contact with the rear edge portion of each guide part 34, and the unit side board 27 is restricted from being moved to the front side with respect to the casing 20.

The unit side connector 28 of the development unit 8 includes a unit side holder 45 directly fixed to a rear end portion of a lower face of the unit side board 27 and a plurality of unit side terminals 46 held by the unit side holder 45. On a rear face of the unit side holder 45, a recess 47 is provided. In the recess 47, the plurality of unit side terminals 46 are stored. The plurality of unit side terminals 46 are aligned in the left-and-right direction. Each unit side terminal 46 is formed in a pin-like shape, and extends along the front-and-rear direction.

The biasing member 29 of the development unit 8 is made of one wire material. The biasing member 29 is arranged at a right end side (one end side in the width direction) of the unit sideboard 27. The biasing member 29 includes a coil spring 50, a first engagement part 51 extending from the coil spring 50 to the front side (the first side in the front-and-rear direction) and a second engagement part 52 extending from the coil spring 50 to the rear side (the second side in the front-and-rear direction). An axial direction of the coil spring 50 is the front-and-rear direction. The first engagement part 51 is formed in a hook-like shape, and is engaged with a front edge portion (an edge portion at the first side in the front-and-rear direction) of the unit side board 27. The second engagement part 52 is formed in a coil-like shape, and is engaged with the engagement protrusion 38 of the right guide part 34 of the casing 20. According to the above configuration, the biasing member 29 biases the unit side board 27 to the rear side (the second side in the front-and-rear direction).

Next, the apparatus main body 2 will be further described.

With reference to FIG. 2, the apparatus main body 2 includes a main body side board 61, a main body side connector 62 mounted on a lower portion of the main body side board 61 and a main body side joint 63 and a fitting cylinder 64 provided at an upper side of the main body side board 61.

The main body side board 61 of the apparatus main body 2 is formed in a flat plate shape elongated in the left-and-right direction. The main body side board 61 is fixedly provided and unmovable. At an upper portion of the main body side board 61, a notch 66 is provided.

Figure 6A:
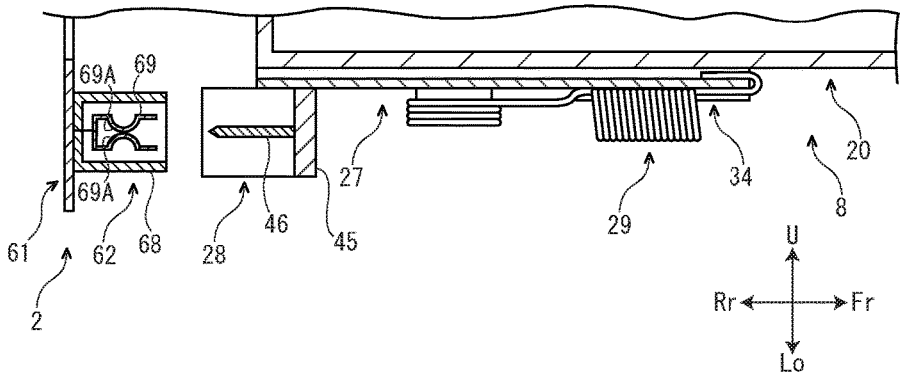
FIG. 6A is a sectional view showing a state in a middle of attachment of the development unit to the apparatus main body, in the image forming apparatus according to the embodiment of the present disclosure.
Figure 6B:
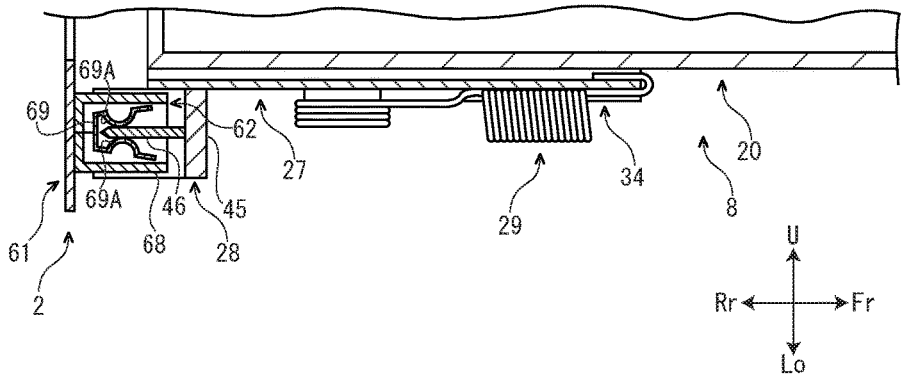
FIG. 6B is a sectional view showing a state where the development unit is attached to the apparatus main body and before a casing is pushed back to a front side, in the image forming apparatus according to the embodiment of the present disclosure.
Figure 6C:
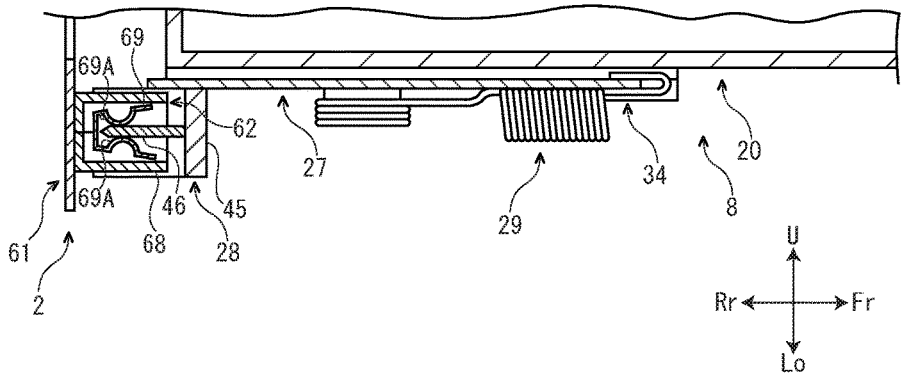
FIG. 6C is a sectional view showing a state where the development unit is attached to the apparatus main body and the casing is pushed back to the front side, in the image forming apparatus according to the embodiment of the present disclosure.

With reference to FIG. 2 and FIG. 6A to FIG. 6C, the main body side connector 62 of the apparatus main body 2 includes a main body side holder 68 directly fixed to a lower portion of a front face (a face at the first side in the front-and-rear direction) of the main body side board 61 and a plurality of main body side terminals 69 (only one of them is shown in FIG. 6A to FIG. 6C) held by the main body side holder 68. The plurality of main body side terminals 69 are aligned in the left-and-right direction. Each main body side terminal 69 is made of a plate spring. Each main body side terminal 69 includes a pair of upper and lower contact portion 69A.

With reference to FIG. 2, the main body side joint 63 of the apparatus main body 2 is inserted in the notch 66 of the main body side board 61. The main body side joint 63 is rotatable. The main body side joint 63 is connected to a drive source (not shown) constituted by a motor and the others.

The fitting cylinder 64 of the apparatus main body 2 is inserted in the notch 66 of the main body side board 61. The fitting cylinder 64 extends along the front-and-rear direction.

Next, in the image forming apparatus 1 configured as described above, an operation to develop the electrostatic latent image formed on the photosensitive drum 7 by the development unit 8 will be described.

First, in a state where the development unit 8 is attached to the apparatus main body 2, the main body side joint 63 is rotated by the drive source (not shown). When the main body side joint 63 is thus rotated, the unit side joint 26 coupled to the main body side joint 63 is rotated integrally with the main body side joint 63. When the unit side joint 26 is thus rotated, the rotation is transmitted to each agitating screw 21, the sleeve 22B of the magnetic roller 22 and the sleeve 24B of the development roller 24 via the gear train (not shown), and each agitating screw 21, the sleeve 22B of the magnetic roller 22 and the sleeve 24B of the development roller 24 are rotated.

With reference to FIG. 3, when each agitating screw 21 is rotated as described above, the developer stored in the storage space P of the casing 20 is agitated and then charged. The charged developer is brought up by magnetic force of each magnetic pole 22A of the magnetic roller 22 and carried on the sleeve 22B of the magnetic roller 22. The developer carried on the sleeve 22B of the magnetic roller 22 is conveyed with the rotation of the sleeve 22B of the magnetic roller 22 and then its thickness is regulated by the blade 23. The toner contained in the developer whose thickness is regulated is moved from the sleeve 22B of the magnetic roller 22 to the sleeve 24B of the development roller 24. The toner moved to the sleeve 24B of the development roller 24 is conveyed with the rotation of the development roller 24, and then is moved from the sleeve 24B of the development roller 24 to the photosensitive drum 7. That is, the toner is supplied from the sleeve 24B of the development roller 24 to the photosensitive drum 7. Thereby, the electrostatic latent image formed on the photosensitive drum 7 is developed.

Next, in the image forming apparatus 1 configured as described above, an operation to attach the development unit 8 to the apparatus main body 2 by an operator such as a user and a service man will be described.

When the operator attaches the development unit 8 to the apparatus main body 2, the operator pushes the development unit 8 from the front side to the rear side. Then, as shown in FIG. 6A, each unit side terminal 46 of the unit side connector 28 faces each main body side terminal 69 of the main body side connector 62. When the operator pushes the development unit 8 further from the front side to the rear side, as shown in FIG. 6B, the development unit 8 is attached to the apparatus main body 2. When the development unit 8 is thus attached to the apparatus main body 2, each unit side terminal 46 of the unit side connector 28 is fitted to each main body side terminal 69 of the main body side connector 62 from the front side (the first side in the front-and-rear direction). Then, each unit side terminal 46 contacts each contact portion 69A of each main body side terminal 69 to electrically connect the unit side connector 28 to the main body side connector 62.

In addition, when the development unit 8 is attached to the apparatus main body 2 as described above, the unit side joint 26 of the development unit 8 is coupled to the main body side joint 63 of the apparatus main body 2 and the fitting protrusion 33 of the development unit 8 is fitted to the fitting cylinder 64 of the apparatus main body 2. Thereby, it becomes possible to transmit the rotation from the main body side joint 63 to the unit side joint 26, and the development unit 8 is positioned with respect to the apparatus main body 2.

By the way, when the development unit 8 is attached to the apparatus main body 2 as described above, as shown in FIG. 6C, the casing 20 is pushed back to the front side (the first side in the front-and-rear direction) by reaction force generated at the coupled portion of the unit side joint 26 and the main body side joint 63. At the time, if the unit side board 27 and the unit side connector 28 are pushed back to the front side integrally with the casing 20, the fitting state of the main body side connector 62 and the unit side connector 28 may become unstable, or the main body side connector 62 and the unit side connector 28 may be damaged.

Then, in the present embodiment, the unit side board 27 is supported by the casing 20 so as to be movable along the front-and-rear direction and the unit side board 27 is biased to the rear side (the second side in the front-and-rear direction) by the biasing member 29. By applying such a configuration, if the casing 20 is pushed back to the front side (the first side in the front-and-rear direction) as shown in FIG. 6C, it becomes possible to restrict the unit sideboard 27 and the unit side connector 28 from being pushed back to the front side integrally with the casing 20. Thereby, it becomes possible to make the fitting state of the main body side connector 62 and the unit side connector 28 stable and to inhibit the main body side connector 62 and the unit side connector 28 from being damaged. Therefore, it becomes possible to inhibit electrical connection failure of the main body side connector 62 and the unit side connector 28.

In order to make the fitting state of the main body side connector 62 and the unit side connector 28 stable, an elastic deformation area of the plate spring constituting each main body side terminal 69 may become large. However, if such a configuration is employed, when each unit side terminal 46 contacts each main body side terminal 69 shallowly, a contact pressure of each unit side terminal 46 and each main body side terminal 69 becomes small. On the other hand, while when each unit side terminal 46 contacts each main body side terminal 69 deeply, the contact pressure of each unit side terminal 46 and each main body side terminal 69 becomes large. That is, the contact pressure of each unit side terminal 46 and each main body side terminal 69 is not constant. This cannot make the electric connection of the main body side connector 62 and the unit side connector 28 stable.

Then, in the present embodiment, not by making the elastic deformation area of the plate spring constituting each main body side terminal 69 large but by biasing the unit side board 27, which is movable in the front-and-rear direction, to the rear side, the fitting state of the main body side connector 62 and the unit side connector 28 is made to be stable. Therefore, it becomes possible to keep the contact pressure of each unit side terminal 46 and each main body side terminal 69 constant and to make the electrical connection of the main body side connector 62 and the unit side connector 28 stable.

The present embodiment applies a configuration that the connectors 28 and 62 mounted on the boards 27 and 61 are fitted to each other (hereinafter, called as a "board to board" structure). By applying such a board to board structure, compared with a case where a connector and a drawer connected to the boards 27 and 61 via a wire are fitted to each other, it becomes possible to electrically connect the boards 27 and 61 by a simple structure. However, when the board to board structure is applied, if the casing 20 is pushed back to the front side (the first side in the front-and-rear direction) as described above, the main body side connector 62 and the unit side connector 28 may be easily damaged. Therefore, applying the above described configuration provides high effect to inhibit the damage of the main body side connector 62 and the unit side connector 28.

Additionally, the both left and right side portions (the both side portions in the width direction) of the unit side board 27 are engaged with the guide groove 39 of each guide part 34 so that the casing 20 supports the unit side board 27 so as to be movable in the front-and-rear direction. By applying such a configuration, it becomes possible to move the unit side board 27 along the front-and-rear direction smoothly by a simple structure.

Additionally, each contact piece 43 of the unit side board 27 comes into contact with each guide part 34 so that the unit side board 27 is restricted from being moved to the front side (the first side in the front-and-rear direction) with respect to the casing 20. By applying such a configuration, it becomes possible to inhibit the unit side board 27 from being excessively moved with respect to the casing 20.

Additionally, the biasing member 29 includes the coil spring 50 whose axial direction is the front-and-rear direction. By applying such a configuration, it becomes possible to bias the unit side board 27 to the rear side (the second side in the front-and-rear direction) stably.

Additionally, the biasing member 29 further includes the first engagement part 51 extending from the coil spring 50 to the front side (the first side in the front-and-rear direction) and engaged with the front edge portion (the edge portion at the first side in the front-and-rear direction) of the unit side board 27 and the second engagement part 52 extending from the coil spring 50 to the rear side (the second side in the front-and-rear direction) and engaged with the casing 20. By applying such a configuration, it becomes possible to bias the unit side board 27 surely by a simple structure.

Additionally, the present embodiment applies the configuration of the present disclosure to the development unit 8 as an example of a unit. By applying such a configuration, it becomes possible to make the electrical connection between the apparatus main body 2 and the development unit 8 stable and to inhibit detection failure of the toner concentration sensor 25.

The present embodiment applies the configuration of the present disclosure to the development unit 8 as an example of a unit. On the other hand, in other embodiments, the configuration of the present disclosure may be applied to a unit (a drum unit including the photosensitive drum 7, a secondary transferring unit including the secondary transferring part 13, a fixing unit including the fixing device 14 and the toner container 15) other than the development unit 8.

In the description of the present embodiment, the image forming apparatus 1 is the multifunctional peripheral. On the other hand, in other embodiments, the image forming apparatus 1 may be a printer, a copying machine or a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an apparatus main body; and a unit detachably attached to the apparatus main body along one direction, wherein the apparatus main body includes:

a main body side board; and a main body side connector mounted on the main body side board, the unit includes:

a unit side board;

a unit side connector mounted on the unit side board and fitted to the main body side connector from a first side in the one direction as the unit is attached to the apparatus main body;

a supporting member supporting the unit side board so as to be movable along the one direction; and a biasing member biasing the unit side board to a second side in the one direction, wherein the supporting member includes a pair of guide parts extending along the one direction, and both side portions in a width direction of the unit side board are engaged with the pair of guide parts so that the supporting member supports the unit side board so as to be movable along the one direction.

2. The image forming apparatus according to claim 1, wherein at the both side portions in the width direction of the unit side board, a pair of contact pieces are protruded to both outer sides in the width direction of the unit side board, and the pair of contact pieces come into contact with the pair of guide parts so that the unit side board is restricted from being moved to the first side in the one direction with respect to the supporting member.

3. The image forming apparatus according to claim 1, wherein the biasing member includes a coil spring whose axial direction is the one direction.

4. The image forming apparatus according to claim 1, wherein the biasing member is made of one wire material.

5. The image forming apparatus according to claim 1, further comprising an image carrier on which a toner image is carried, wherein the unit is a development unit which supplies a toner to the image carrier.

6. An image forming apparatus comprising:

an apparatus main body; and a unit detachably attached to the apparatus main body along one direction, wherein the apparatus main body includes:

a main body side board; and a main body side connector mounted on the main body side board, the unit includes:

a unit side board;

a unit side connector mounted on the unit side board and fitted to the main body side connector from a first side in the one direction as the unit is attached to the apparatus main body;

a supporting member supporting the unit side board so as to be movable along the one direction; and a biasing member biasing the unit side board to a second side in the one direction, wherein the biasing member includes:

a coil spring whose axial direction is the one direction, a first engagement part extending from the coil spring to the first side in the one direction and engaged with an edge portion at the first side in the one direction of the unit side board; and a second engagement part extending from the coil spring to the second side in the one direction and engaged with the supporting member.

7. The image forming apparatus according to claim 6, wherein the first engagement part is formed in a hook-like shape, and the second engagement part is formed in a coil-like shape.

* * * * *